US008931393B1

(12) United States Patent
Vincent et al.

(10) Patent No.: US 8,931,393 B1
(45) Date of Patent: Jan. 13, 2015

(54) REPLACEMENT STOCK SYSTEM FOR RIFLE

(71) Applicants: Jeff Vincent, Fresno, CA (US); Roger Venturi, Clovis, CA (US)

(72) Inventors: Jeff Vincent, Fresno, CA (US); Roger Venturi, Clovis, CA (US)

( * ) Notice: Subject to any disclaimer, the term of this patent is extended or adjusted under 35 U.S.C. 154(b) by 0 days.

(21) Appl. No.: 13/815,351

(22) Filed: Feb. 22, 2013

Related U.S. Application Data

(60) Provisional application No. 61/634,102, filed on Feb. 23, 2012.

(51) Int. Cl.
*F41A 17/46* (2006.01)
*F41A 19/10* (2006.01)

(52) U.S. Cl.
CPC ..... *F41A 17/46* (2013.01); *F41A 19/10* (2013.01)
USPC ..... 89/136; 89/27.3; 42/70.06

(58) Field of Classification Search
CPC ..... F41A 17/22; F41A 17/46; F41A 17/52
USPC ..... 42/70.06, 70.07; 89/136, 148, 27.3
See application file for complete search history.

(56) References Cited

U.S. PATENT DOCUMENTS

| | | | | |
|---|---|---|---|---|
| 2,225,583 | A * | 12/1940 | Blizard | 42/70.06 |
| 2,589,912 | A | 3/1952 | Weld | |
| 2,941,326 | A | 6/1960 | Hamil et al. | |
| 3,439,441 | A | 4/1969 | Lawley | |
| 3,611,607 | A | 10/1971 | Donnell | |
| 3,771,415 | A | 11/1973 | Into et al. | |
| 3,776,095 | A | 12/1973 | Atchisson | |
| 3,842,527 | A | 10/1974 | Low | |
| 4,385,464 | A | 5/1983 | Casull | |
| 4,430,822 | A | 2/1984 | Fromming et al. | |
| 4,515,064 | A | 5/1985 | Hohrein | |
| 4,663,876 | A | 5/1987 | Reaume | |
| 4,677,781 | A * | 7/1987 | Lee | 42/70.01 |
| 4,890,405 | A | 1/1990 | Krouse | |
| 5,173,564 | A | 12/1992 | Hammond, Jr. | |
| 5,228,887 | A | 7/1993 | Mayer | |
| 5,343,650 | A | 9/1994 | Swan | |
| 5,412,895 | A | 5/1995 | Krieger | |
| 5,827,992 | A | 10/1998 | Harris et al. | |
| 6,293,040 | B1 | 9/2001 | Luth | |
| 6,314,672 | B2 | 11/2001 | Murello et al. | |
| 6,490,822 | B1 | 12/2002 | Swan | |
| 6,499,245 | B1 | 12/2002 | Swan | |
| 6,606,934 | B1 | 8/2003 | Rock et al. | |
| 6,651,371 | B2 | 11/2003 | Fitzpatrick et al. | |
| 6,839,998 | B1 | 1/2005 | Armstrong | |
| 7,500,327 | B2 * | 3/2009 | Bubits | 42/69.02 |
| 7,793,452 | B1 | 9/2010 | Samson et al. | |
| 8,079,169 | B2 | 12/2011 | Gregg | |

FOREIGN PATENT DOCUMENTS

WO WO 2011/000004 * 1/2011

* cited by examiner

*Primary Examiner* — Stephen M Johnson

(57) ABSTRACT

A trigger assembly group of the type used with a rifle stock replacement system is provided. The trigger assembly group and may include a trigger assembly, including a trigger coupled to a trigger rod, a locking plate coupled to the trigger rod and a preload cylinder coupled to the locking plate. This in combination with the firing elements of the existing rifle may comprise a firing control mechanism. The trigger assembly group may also include a trigger block with a recess adapted to receive the trigger rod and the locking plate. A safety spool may be a part of the trigger assembly group and include a cross hole, which may be adapted to receive the preload cylinder when the safety spool is in a first position and not receive the preload cylinder when the safety spool is in a second position.

22 Claims, 11 Drawing Sheets

REPLACEMENT STOCK SYSTEM FOR RIFLE

CROSS-REFERENCE TO RELATED APPLICATION DATA

Priority is claimed under 35 U.S.C. §119(e) to U.S. Provisional Application No. 61/634,102, filed on Feb. 23, 2012, which is incorporated by reference herein.

FIELD OF THE INVENTION

The present invention generally relates to firearm modification packages and, more particularly, replacement stock systems including safety mechanisms for firearms.

BACKGROUND OF THE INVENTION

In the 1940's, after WWII, the US Military desired a replacement rifle for the M-1, the Browning Automatic Rifle, the Carbine and the M3 A-1 Sub-machine gun. In many cases a squad would be carrying each of these four weapons in battle. The variety of weapons and ammunition was inefficient and as such, a replacement weapon for all four of the above mentioned weapons was developed. This weapon was the U.S. Rifle M14.

The M-14 uses a standard 7.62 mm×51 NATO round and may be fired semiautomatic (one round fired with each trigger pull), or full automatic (continuous fire as long as the trigger is held in the firing position and there are rounds in the magazine). The M14 has a muzzle velocity of 800 m/s (2800 ft/sec) and provides a high degree of accuracy along with an effective range rating of 800 meters (with optics). The M14 is still used today as a sniper rifle in some military units. The M14 works well in dirty conditions, providing a reliable platform for putting rounds down range with a firing rate of 700-750 rounds per minute. Numerous variations of the M14 have been made including the M39 Enhanced Marksman Rifle (EMR). This is used by a Designated Marksman when precision fire is needed but does not rate a Scout Sniper. In addition, Marine Scout Snipers and Explosive Ordnance Disposal teams use this platform when rapid and accurate fire is needed.

In the 1960's, during the Vietnam conflict, solders complained of the weight of the M-14 in jungle warfare. An M-14 with a loaded 20 round magazine and no optics weighs 11.5 lbs. New on the scene was the M-16, which uses the smaller 5.56 mm×45 NATO round. A M16A1 with a full 30 round magazine weighed in at a mere 7.9 lbs. The slightly modified M16A2 had a firing rate of 700-950 rounds per minute and a muzzle velocity of 950 m/s (3100 ft/sec), both greater than the M14, but the maximum effective range was lower at 550 meters. The smaller 5.56 mm M16 round not only lacked in the range of the M14, but also lacked stopping power compared to the 7.62 mm round of the M14. The M14 has a 22 inch barrel with an overall length of 44 inches. The M16A2 is 39.5 inches long and all M16 variations use a 20 inch barrel. Other variations of the M16, including the M4 Carbine uses a 14.5 inch barrel with an extended stock length of 33 inches. The shorter barrel reduces the maximum effective range but the shorter rifle makes maneuvering the rifle in a shooting position easier when clearing buildings and going through doorways.

In today's urban warfare environments, it may be desirable to combine the reliable and more powerful platform of the M14, but put it in a lighter and more compact tactical weapon platform. This need may be met by the Bullpup. The Bullpup may take the M14's 22 inch barrel, receiver and trigger group and position it in a stock to provide a more compact weapon than the 44 inch traditional M14 rifle. This may be done by locating the proximal end of the barrel behind the trigger group. To accomplish this, the stock and rail assemblies may be replaced and a new trigger assembly added, which actuates the existing M14 trigger assembly. The existing barrel of the M14 is still used. There have been attempts to create Bullpup rifles, which have been met with limited success. A common area of deficiency of existing systems is the interaction between the new trigger and the existing M14 trigger, several inches away. In addition to the coupling of the actuation of the old trigger with the new trigger, there is a need for a reliable safety to prevent actuation of the weapon when set to "safe". The firing control mechanism as shown and described may provide these features.

SUMMARY OF THE INVENTION

The present invention provides a trigger assembly group of the type used with a rifle stock replacement system. The trigger assembly group may include a trigger assembly, including a trigger coupled to a trigger rod, a locking plate coupled to the trigger rod and a preload cylinder coupled to the locking plate. The trigger assembly group may also include a trigger block with a recess adapted to receive the trigger rod and the locking plate. A safety spool may be a part of the trigger assembly group and include a cross hole, which may be adapted to receive the preload cylinder when the safety spool is in a first (firing) position and not receive the preload cylinder when the safety spool is in a second (safety) position.

The preload cylinder may include a threaded screw portion and be received in the locking plate, thereby providing the ability to adjust the position of the preload cylinder relative to the locking plate. The trigger assembly group may also include a preload locking screw, which may be received by the locking plate and positioned non-collinear with the preload cylinder, and may be positioned substantially orthogonal to the preload cylinder. The preload locking screw may be adapted to provide a frictional force on the preload cylinder to restrict movement of the preload cylinder relative to the locking plate, thus locking it in place.

The trigger assembly group may also include a front trigger stop received by the trigger block and may be positioned to restrict the movement of the trigger assembly in a direction opposite to the first direction, or restrict movement toward the muzzle end of the firearm. There also may be included a trigger stop locking screw which may be received by the trigger block and may be positioned non-collinear with the front trigger stop. The trigger stop locking screw may be positioned substantially orthogonal to the front trigger stop, whereby the trigger stop locking screw may provide a frictional force on the front trigger stop to restrict movement of the front trigger stop relative to the trigger block, thereby locking the front trigger stop in place.

A safety spool pin may be provided and received by the trigger block. The safety spool pin may be adapted to provide a resistance to movement of the safety spool relative to the trigger block. This may be done by providing a spring biased ball in the safety spool pin. The ball may provide a frictional force on the safety spool commensurate to the contact surface topography of the safety spool, in that the safety spool may include one or more detent holes that receive the ball, thus releasably locking the safety spool in a position relative to the trigger block.

An exemplary method for restricting the action of a trigger on a firearm for use with a firearm is provided, including the components as previously disclosed and including the steps of rotating the safety spool from the first position to the second position and moving the preload cylinder by way of the trigger and trigger rod such that the preload cylinder contacts the safety cylinder, preventing the firearm from firing. This method may also include the steps of adjusting the position of the preload cylinder relative to the locking plate, providing a preload locking screw and securing the preload cylinder in a position relative to the locking plate by positioning the preload locking screw against the preload cylinder.

The firing control mechanism may include a primary safety lever that captures the original trigger safety tab, which may be a part of the original trigger group. This lever may be rotated toward the rear to disable the original trigger group or forward to enable actuation of the original trigger group. Used in combination with the safety spool and trigger rod described herein, the firearm can be made fully safe. Without this element of the firing control mechanism, the rifle may remain capable of unintended discharge, thus creating a potentially significant safety risk.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which:

FIG. 10*b* is a partially disassembled isometric view of the trigger assembly group as shown in FIG. 9 with a portion of the trigger block removed, the trigger assembly group shown with the safety on.

DETAILED DESCRIPTION OF THE INVENTION

Figure 1:
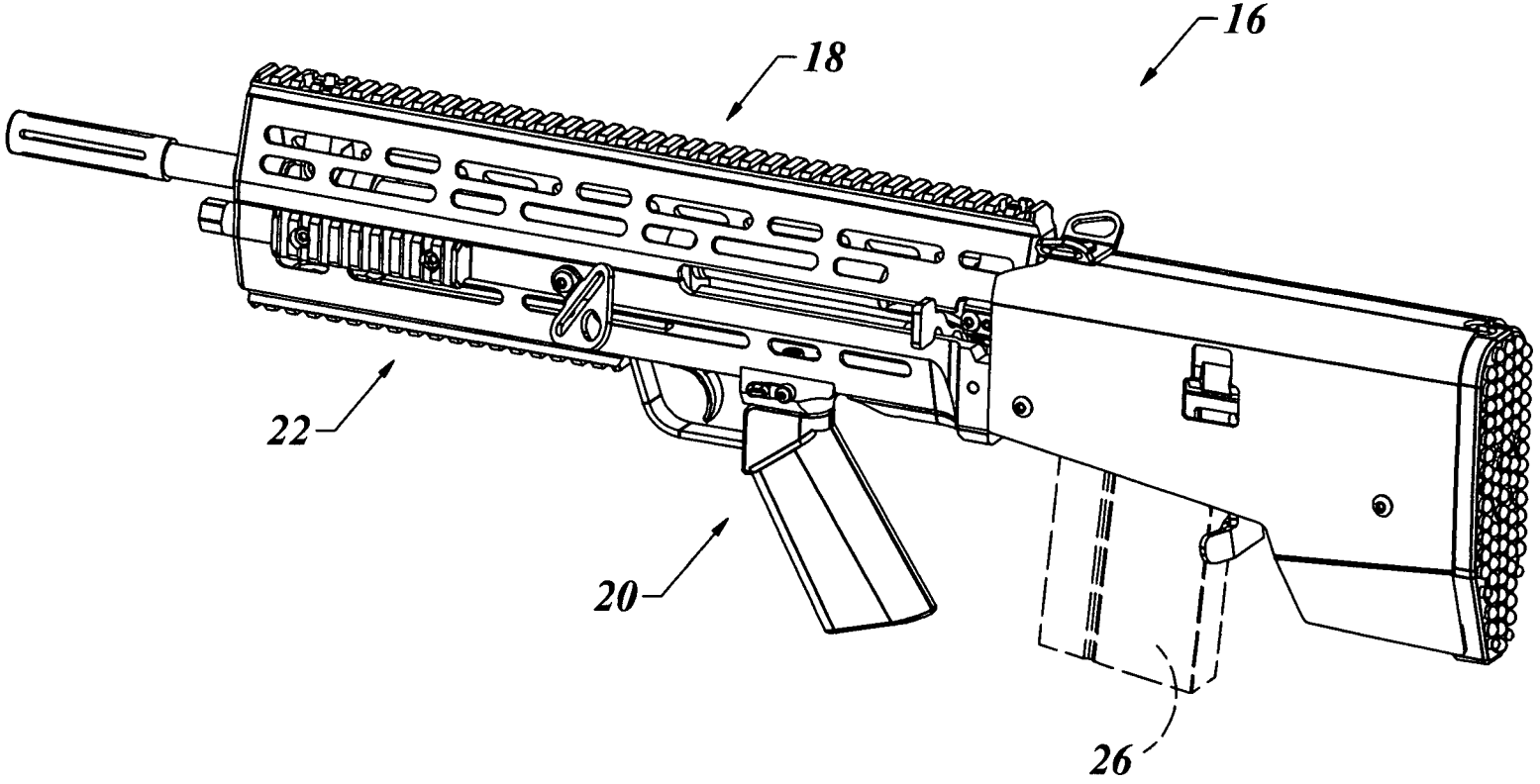
FIG. 1 is an isometric view of an example of a bullpup rifle using a replacement stock system with an improved safety, produced in accordance with the present invention.

With reference to the illustrative drawings, and particularly to FIGS. 1-4, there is shown a rifle assembly 16 including a replacement stock system in accordance with the present invention. The rifle assembly 16 may include an upper rail assembly 18, a trigger assembly group 20 and a stock assembly 22, including a cheek panel 24 and a magazine 26, though the magazine 26 is not considered part of the invention and is shown only for illustrative purposes. In FIG. 1, the rifle assembly 16 is shown in an assembled state.

Figure 2:
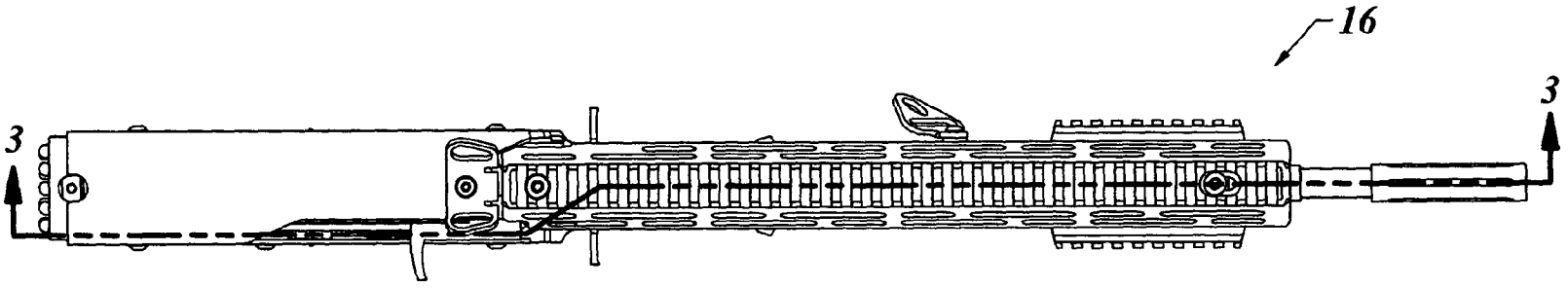
FIG. 2 is a top view of the rifle as shown in FIG. 1.
Figure 3:
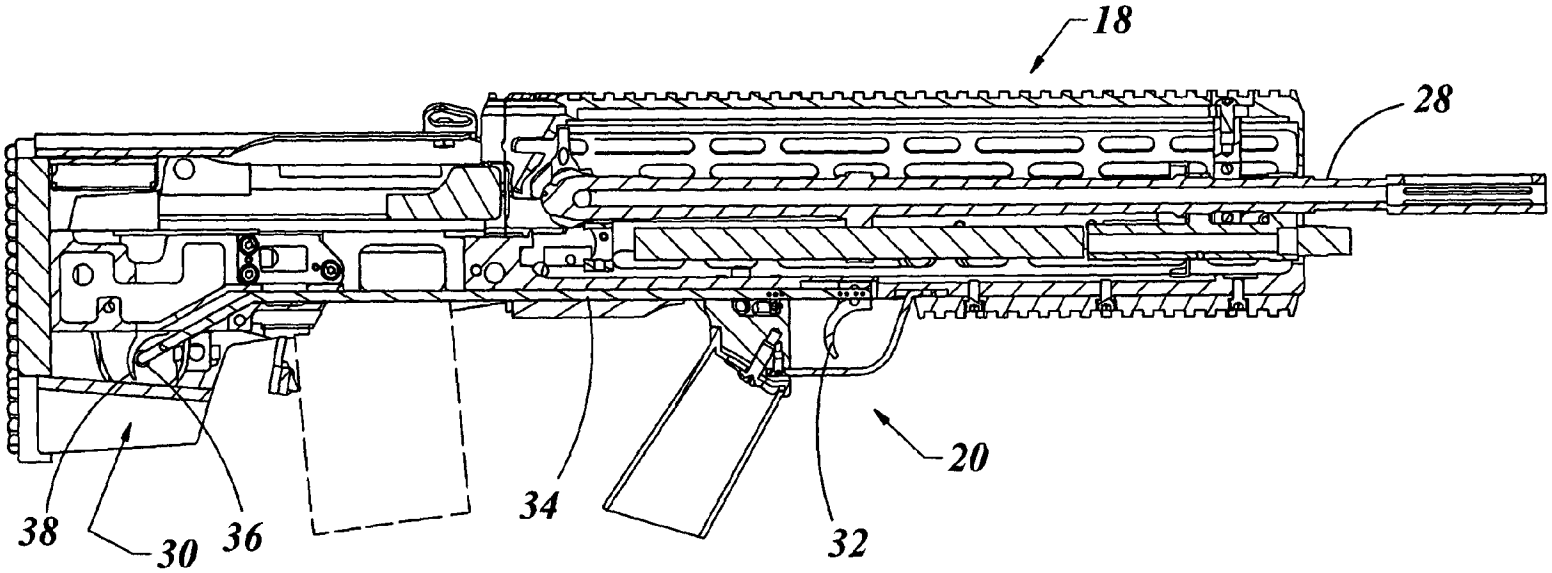
FIG. 3 is a sectioned view of the rifle of FIG. 2 cut along line 3-3 as shown in FIG. 3.

With reference to FIG. 2, the rifle assembly 16, as shown in FIG. 1 from a top view with section line 3-3 shows the location of the section, as shown in FIG. 3. The section shown in FIG. 3 illustrates the interaction of the some parts of an existing rifle assembly 16, such as, some elements of the upper rail assembly 18, including the barrel 28, and the primary trigger group 30 which may work with other elements of the rifle assembly 16, including the trigger assembly group 20, to make a fully functional firearm with a shorter overall length compared to the original rifle.

With reference to FIG. 3, the trigger assembly group 20 may include a secondary trigger 32 coupled to a trigger rod 34 with a trigger roller 36 on a distal end of the trigger rod 34. The trigger roller 36 may articulate with the primary trigger 38 of the primary trigger group 30. If the secondary trigger 32 is actuated toward the rear of the rifle assembly 16, the trigger rod 34 and trigger roller 36 may also move in the same direction to apply a force to the primary trigger 38, which may be used to fire the rifle assembly 16. This combination allows for space optimization in that a longer barrel 28 may be used in a rifle assembly 16 with the shortest possible overall length. As previously noted, this bullpup design may have several advantages in a close quarter combat environment, without sacrificing accuracy provided with longer barrels of a traditional rifle.

Figure 4:
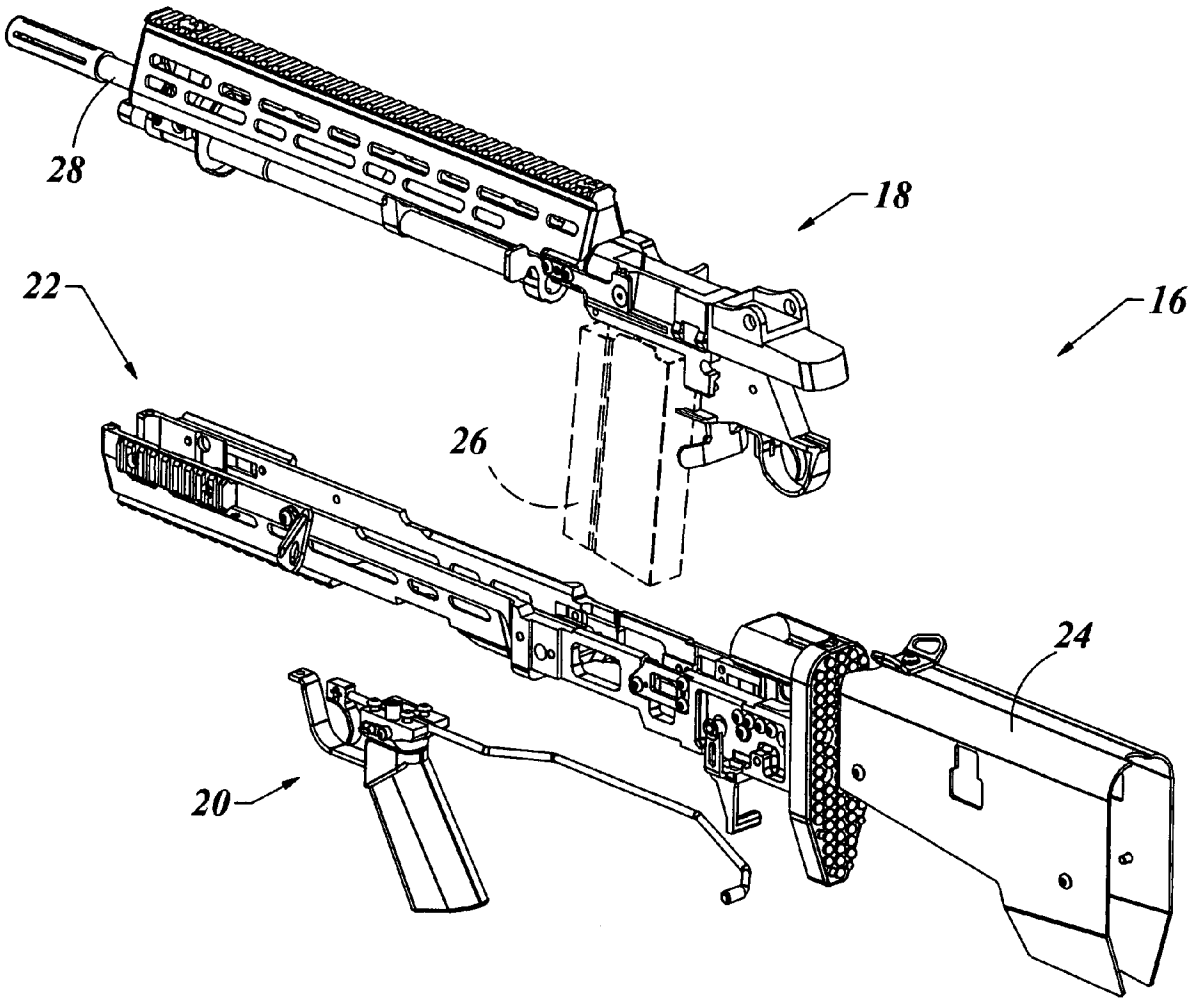
FIG. 4 is an isometric partially disassembled view of the converted rifle shown in FIG. 1.

With reference to FIG. 4, a partially disassembled rifle assembly 16 is shown with the subassemblies of the rifle assembly 16 illustrated in groups. The upper rail assembly 18 is the only subassembly which includes components from an existing rifle. The stock assembly 22, including the cheek panel 24 and the trigger assembly group 20 are all new elements of the replacement stock system of the present invention.

Figure 5:
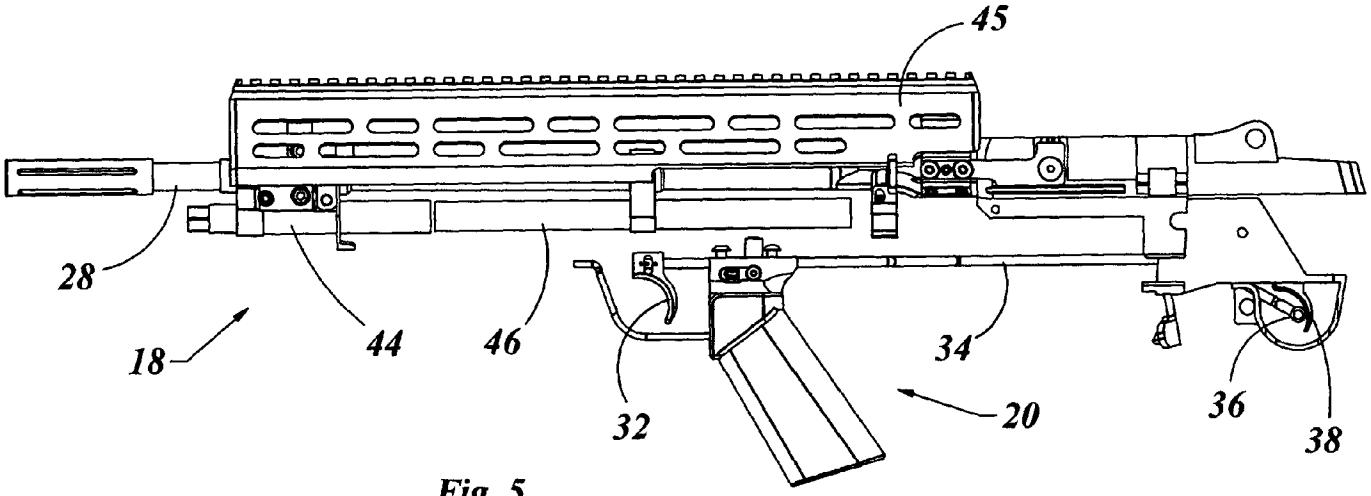
FIG. 5 is a left side view of the rifle of FIG. 1, with the lower stock assembly removed to show the actuation of the trigger mechanism.
Figure 6:
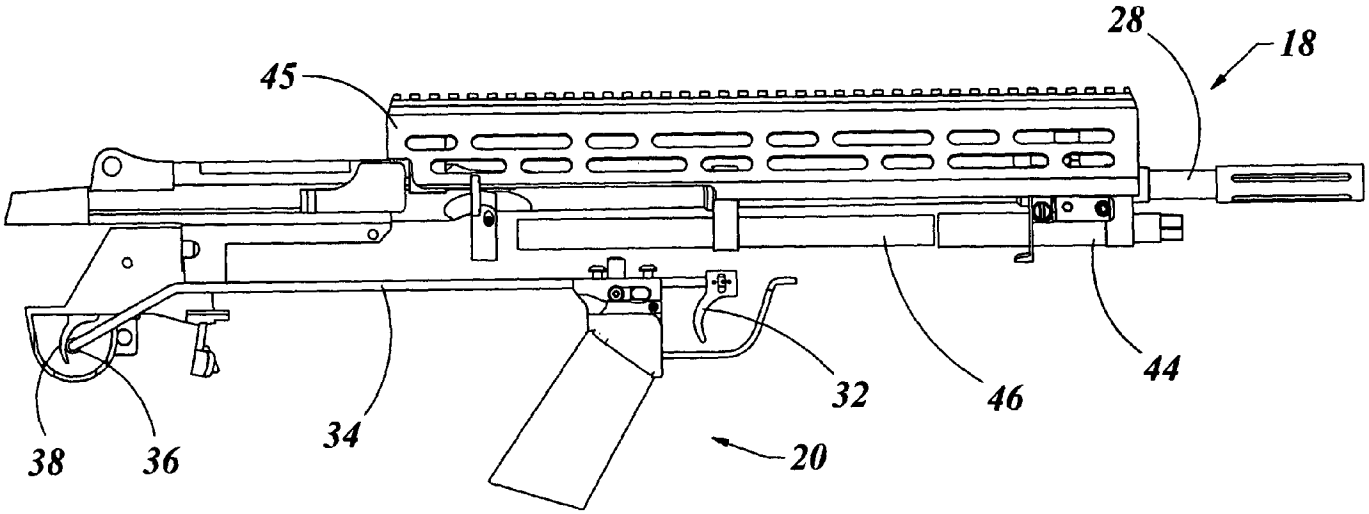
FIG. 6 is a right side view of the rifle of FIG. 1, with the lower stock assembly removed to show the actuation of the trigger mechanism.
Figure 7:
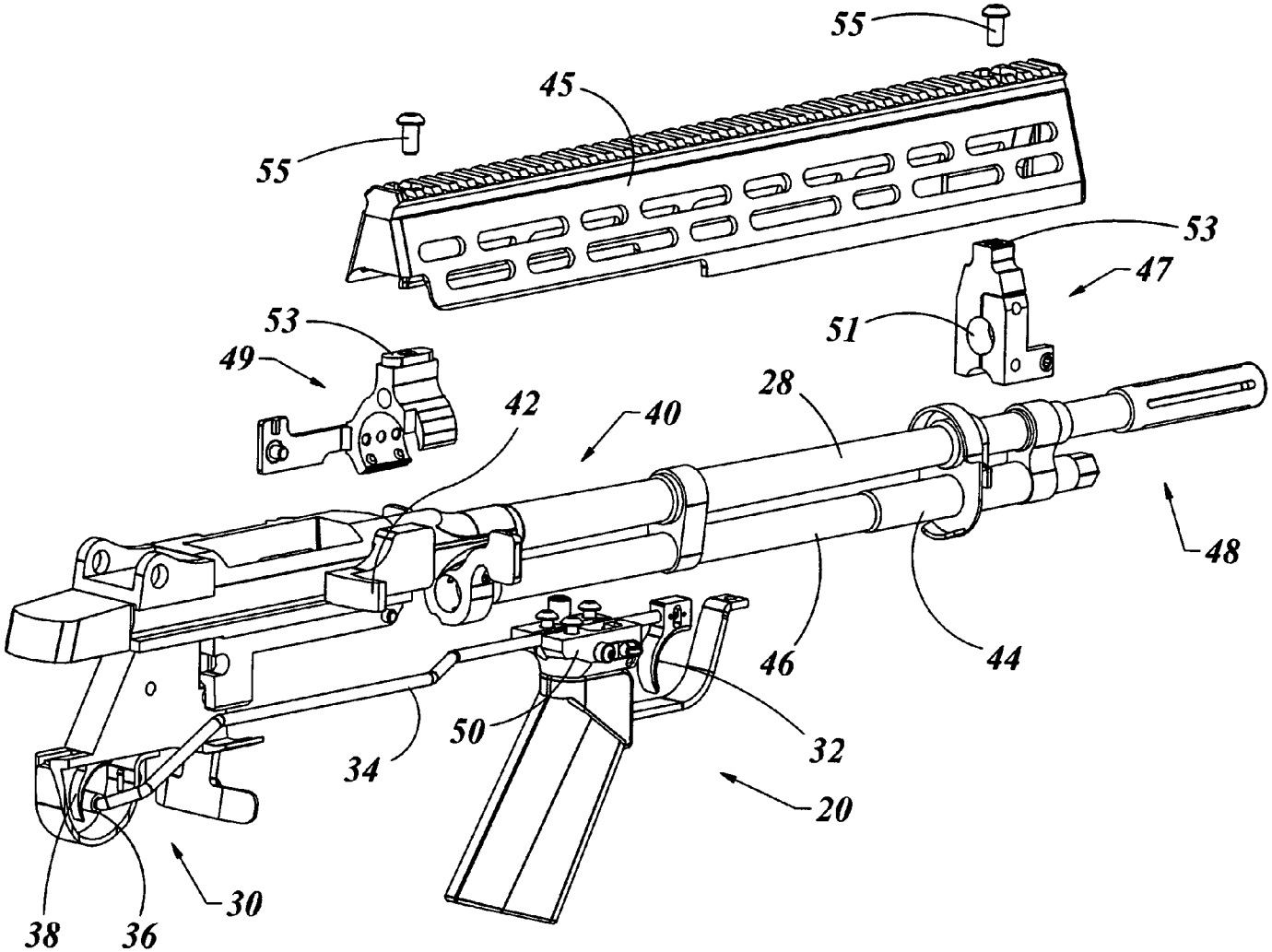
FIG. 7 is an isometric, partially disassembled view of the elements of the rifle as shown in FIG. 5.

The interaction of the "old versus new" of the present invention may be more clearly illustrated in FIGS. 5-7. With the stock assembly 22 removed, the upper rail assembly 18 and the trigger assembly group 20 are clearly shown from a left side in FIG. 5, from a right side in FIG. 6, and an isometric partially disassembled in FIG. 7. In these views, the old parts, namely the barrel assembly group 40, may include the barrel 28, the Op Rod charging handle 42 and primary trigger group 30, including the primary trigger 38. In the case of an automatic or semi automatic gas powered rifle, as is shown here in the barrel assembly group 40, a gas cylinder 44 and operating rod 46 may also be included in the barrel assembly group 40. To fire the rifle assembly 16, the secondary trigger 32 may be used in a manner consistent with the primary trigger 38, if the primary trigger 38 was accessible to a user. In that the primary trigger group 30, and therefore the primary trigger 38 may be obscured and not easily accessible due to the placement of the primary trigger group 30 near the shoulder of the user in the bullpup design, the secondary trigger 32 may be located closer to the muzzle 48, so that the user's trigger finger may be in a more comfortable position when using the rifle assembly 16.

To accomplish this, the secondary trigger may be coupled to the trigger rod 34, which may be supported by a trigger block 50 to assist in guiding the movement of the trigger rod 34, such that the trigger roller 36 on the distal end of the trigger rod 34 may interact to actuate the primary trigger 38 of the primary trigger group 30. The trigger rod 34 may include one or more bends to navigate around the structure of the primary trigger group 30 without interference, which may interfere with the movement of the secondary trigger 32. The trigger roller 36, may provide a smoother actuation of the primary trigger 38 in that the primary trigger 38 may be pivotally coupled to the primary trigger group 30, whereas the secondary trigger 32 may move in a linear fashion relative to the barrel assembly group 40. The interaction of the linear movement with a pivotal movement may require an additional degree of freedom added to the trigger assembly group 20 to compensate for the angular movement of the primary trigger 38. This additional degree of freedom may be provided by the trigger roller 36 being rotatably coupled to the trigger rod 34, thus allowing a bearing surface between the trigger roller 36 and the trigger rod 34. This may provide a smoother transfer of force from the secondary trigger 32 to the primary trigger 38. A smooth trigger pull may provide the user with less superfluous motion during the trigger pull, which may result in a more accurate shot.

In FIG. 7 an upper cover rail 45 is shown displaced from the barrel 28 with the front mount assembly 47 and rear mount assembly 49 located there between. It may be important for the upper cover rail 45 to be precisely located relative to the barrel 28 in that one of the functions of the upper cover rail 45 may be to support any sighting mechanism or optics of the rifle assembly 16. As such, the consistent alignment of the upper cover rail 45 to the barrel 28 may be desirable. This consideration has been solved by the use of the front mount assembly 47, which may include a barrel cavity 51, which may be mounted directly to the barrel 28, near the muzzle 48. In a similar manner, the rear mount assembly 49 may also be mounted directly to the barrel 28, only near the primary trigger group 30. Both the front mount assembly 47 and the rear mount assembly 49 may be precisely manufactured to provide a consistent mounting height surface 53 relative to the barrel 28. The upper cover rail 45 may then be supported on the front mount assembly 47 and the rear mount assembly 49 and fastened thereto by screws 55, thereby providing a reasonably accurate parallel surface of the upper cover rail 45 and the barrel 28.

Figure 8:
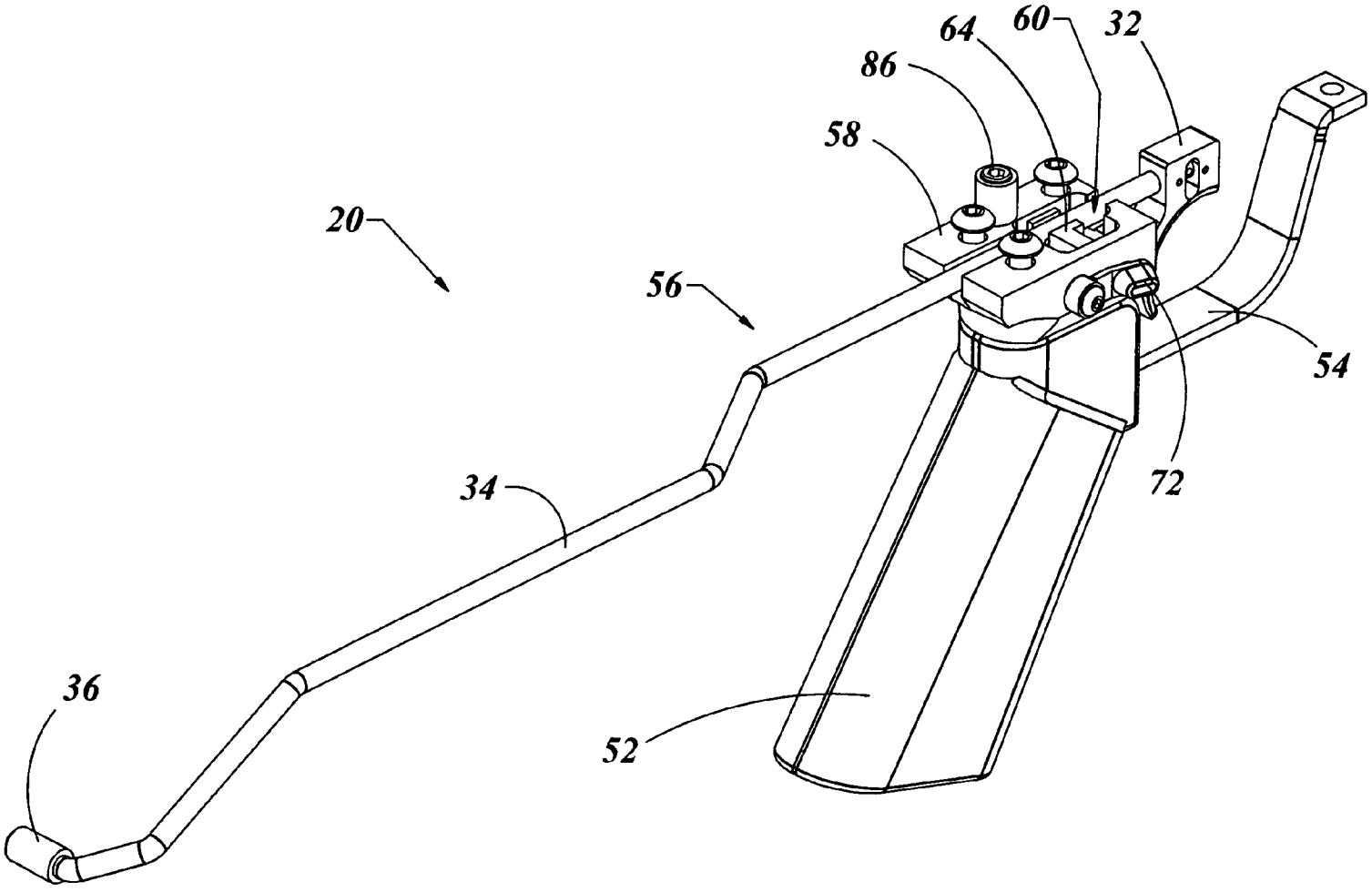
FIG. 8 is an isometric view of a trigger assembly group of the stock replacement system as shown in FIG. 7.
Figure 9:
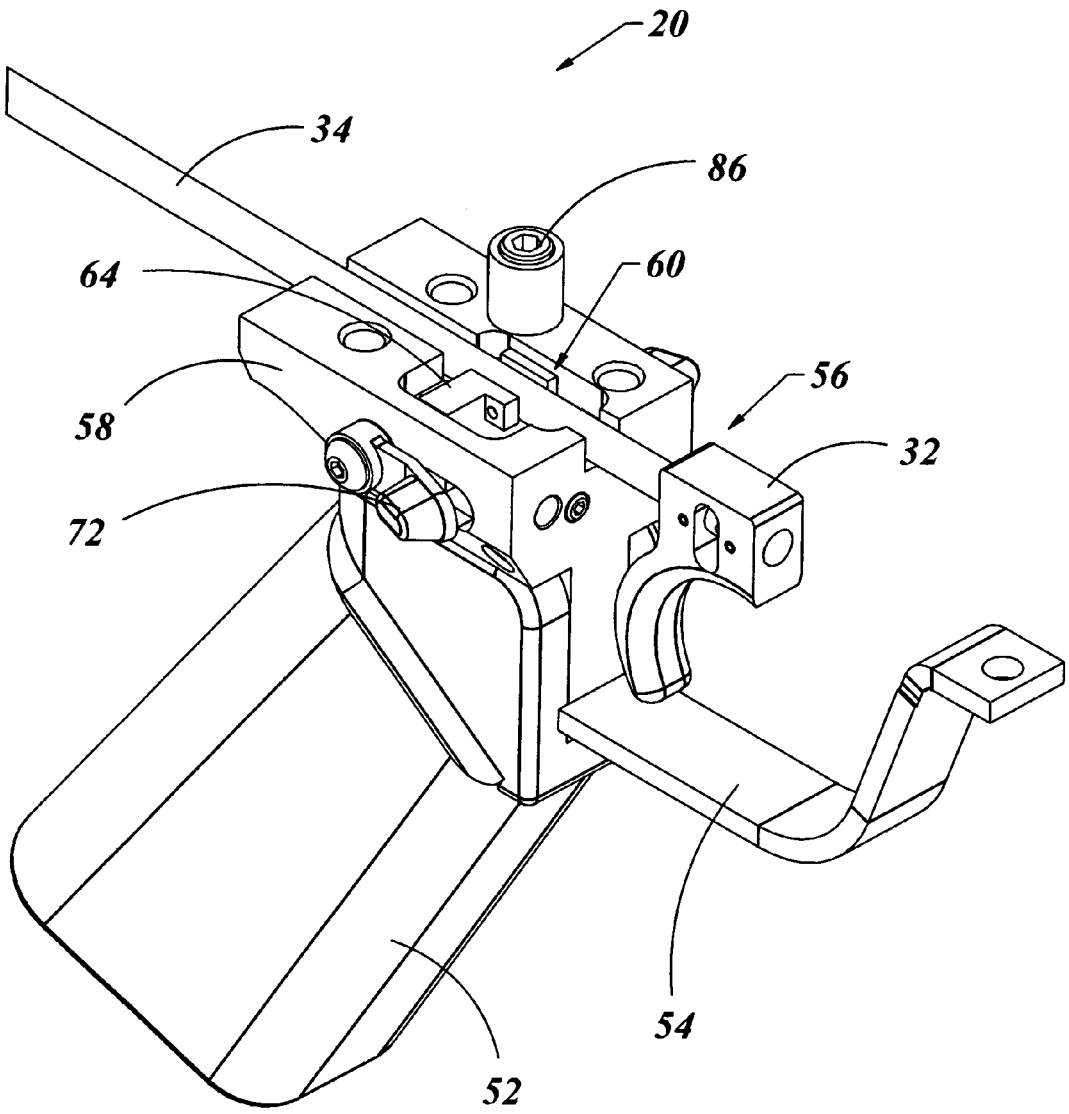
FIG. 9 is an isometric view of the pistol grip, trigger assembly and safety of the trigger assembly group as shown in FIG. 8.

With reference to FIGS. 8-11, the trigger assembly group 20 is shown in more detail. In FIG. 8 an entire trigger assembly group 20 is shown. The trigger assembly group 20 may include a pistol grip 52, a trigger guard 54, along with the trigger assembly 56, which may include the secondary trigger 32, the trigger rod 34 and the trigger roller 36, as previously noted. The trigger block 58 may be disposed on one end of the pistol grip 52 and may provide a recess 60 to receive the trigger assembly 56.

Figure 10B:
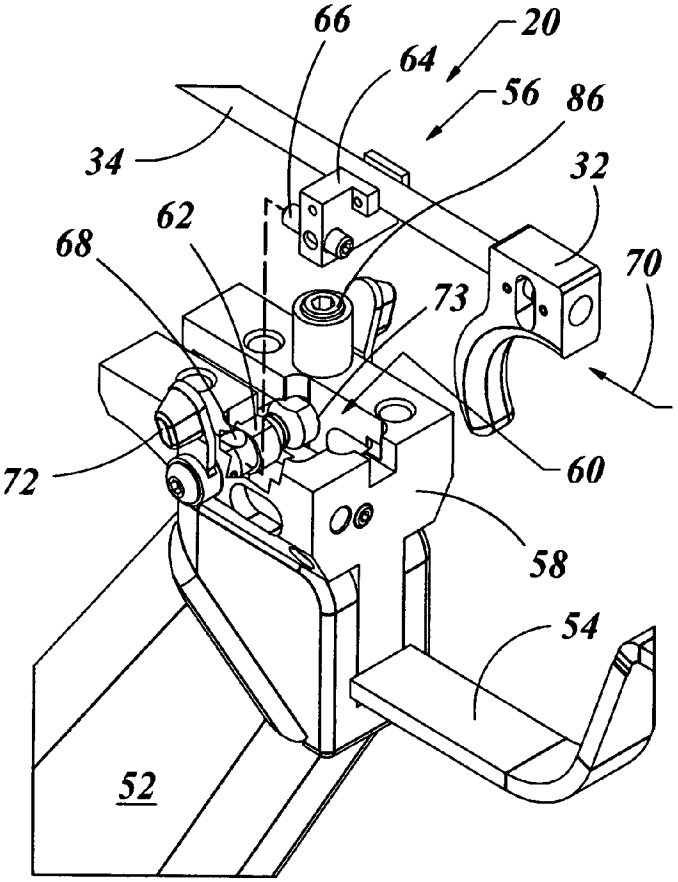
Figure 10A:
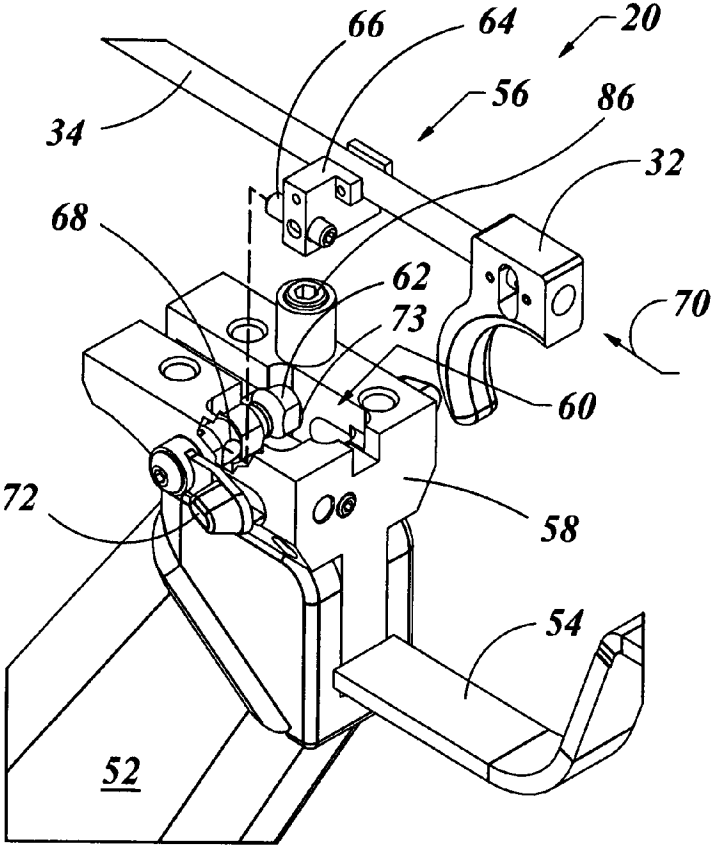
FIG. 10*a* is a partially disassembled isometric view of the trigger assembly group as shown in FIG. 9 with a portion of the trigger block removed, the trigger assembly group shown with the safety off.

With reference to FIGS. 10*a* and 10*b*, the trigger block 58 has a breakout area removed so as to more clearly show some detail of the parts. In addition, the trigger assembly 56 has been displaced from the trigger block 58 to more clearly show the detail of an interaction of the trigger assembly 56 and the safety spool 62. The trigger assembly 56 may also include a locking plate 64 coupled to the trigger rod 34. The locking plate 64 may support a preload cylinder 66, which may take the form of a threaded screw. A portion of the preload cylinder may extend beyond the locking plate 64 in the direction of the safety spool 62. The safety spool 62 may include a cross hole 68, which may be adapted to receive a portion of the preload cylinder 66 when the trigger assembly 56 is moved in the direction of the arrow 70. This safety spool 62 may include one or more safety levers 72. The safety levers 72 maybe rigidly mounted to the safety spool 62, the safety spool 62 may be received by a cylindrical cavity 73 within the trigger block 58 so as to provide a defined angular rotation of the safety spool 62 relative to the trigger block 58.

In this embodiment of the invention, the safety levers 72 are in a down position in FIG. 10*a* where the cross hole 68 of the safety school 62 may be oriented collinear with the preload cylinder 66, when the trigger assembly 56 is received into the trigger block 58. In FIG. 10*b*, the safety levers 72 are elevated such that the cross hole 68 of the safety spool 62 is now substantially orthogonal to the preload cylinder 66, when the trigger assembly 56 is received into the trigger block 58. When the cross hole 68 is not aligned with preload cylinder 66, the preload cylinder 66 will contact the safety spool 62, when the trigger assembly 56 is moved in the direction of the arrow 70, thus limiting its relative movement in that direction. This restriction to movement of the trigger assembly 56 may act as a safety to restrict the movement of the primary trigger 38 (not shown here) and thus prevent the rifle assembly 16 from firing when the safety levers 72 are in the elevated position.

Figure 11:
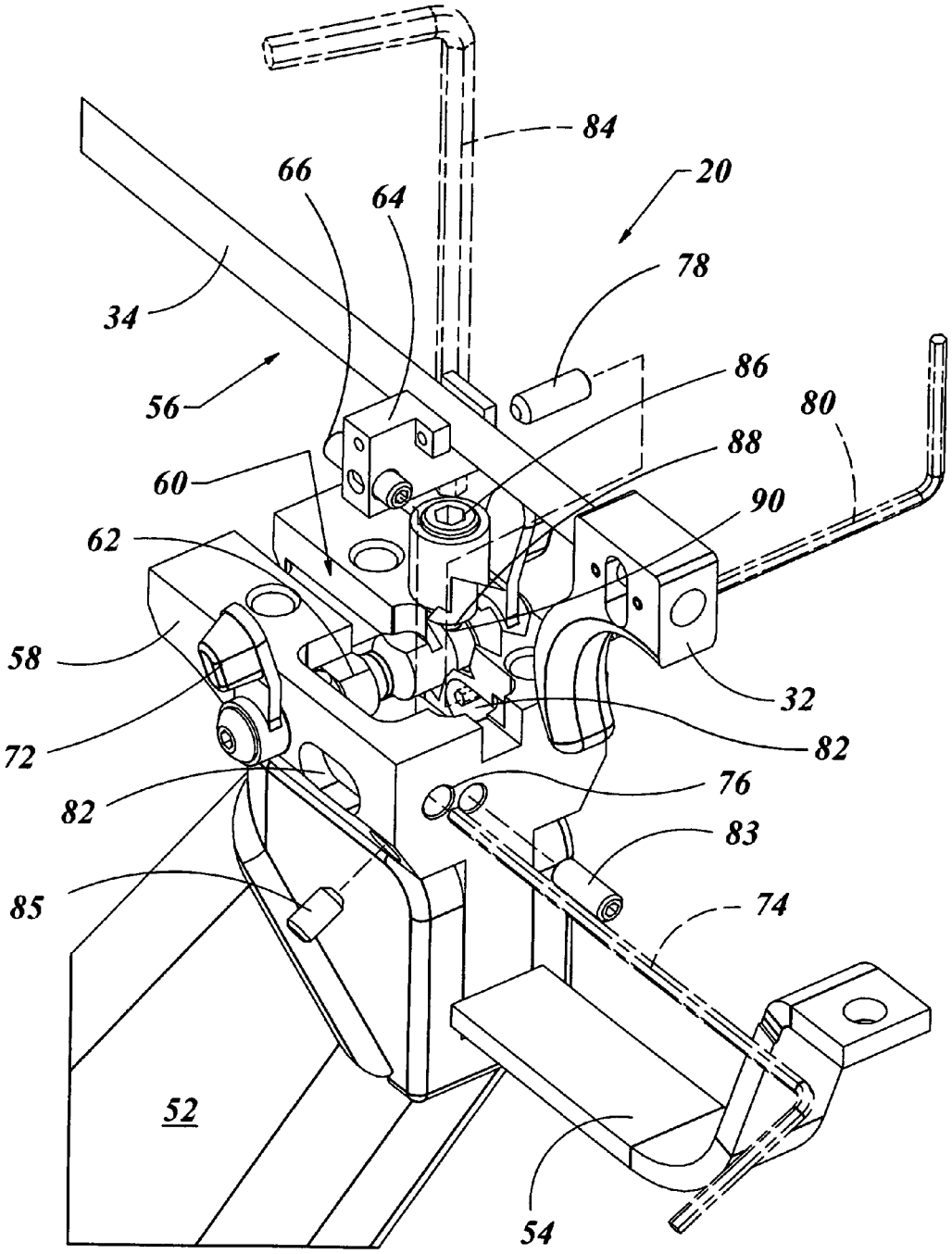
FIG. 11 is an isometric partially disassembled view of the trigger assembly group with a cutaway of a portion of the trigger block of FIG. 10, further illustrating an adjustment process of the trigger assembly and safety.

In FIG. 11 a cropped view of a partially disassembled trigger assembly group 20 is shown. In this view, the trigger block 58 has another breakout on the far side of the trigger block 58. The trigger assembly group 20 may include adjustments, to allow the user to fine tune the feel of the movement of the trigger assembly 56 to the individual desires of the user. One adjustment is that of the preload cylinder 66 relative to the locking plate 64. With the trigger assembly 56 received into the recess 60 of the trigger block 58, a first wrench 74 may be inserted into a first hole 76 to access the preload cylinder 66. In one form of the invention, the preload cylinder 66 may be a threaded screw, threaded into the locking plate 64. The first wrench 74 may then screw or unscrew the preload cylinder 66, thereby altering the distance the preload cylinder 66 extends beyond one surface of the locking plate 64. The farther the preload cylinder 66 extends beyond the locking plate 64, the less travel the secondary trigger 32, and the entire trigger assembly 56, will travel within the trigger block 58 when the safety spool 62 is in the "safety on" position. This is as is shown in FIG. 10*b*, the safety lever 72 is in the up or vertical position. After adjusting the position of the preload cylinder 66, the preload cylinder 66 may essentially be locked in place by the preload locking screw 78. The preload locking screw 78 may also take the form of a threaded screw, and be received by the locking plate 64. The preload locking screw 78 may be positioned substantially orthogonal to the preload cylinder 66. The preload locking screw 78 may contact the preload cylinder 66 both within the locking plate 64, thus providing a frictional force to resist movement of the preload cylinder 66 relative to the locking plate 64. The preload locking screw 78 may be adjusted by the second wrench 80 through a side access hole 82 in the trigger block 58.

A second adjustment may be provided near the trigger guard 54. A front trigger stop 83 may be provided, and may also take the form of a screw. The front trigger stop 83 may be received by the trigger block 58 and threaded in to allow a portion of the front trigger stop 83 to extend into the trigger block recess 60. The front trigger stop 83 may offer interference as a stop to limit the forward movement of the locking plate 64 of the trigger assembly 56. The distance the front trigger stop 83 extends through and into the trigger block recess 60, may determine the distance the trigger assembly 56 may move in the forward direction, toward the trigger guard 54, and also may be adjusted with the first wrench 74. Once the front trigger stop 83 in set in place, the front trigger stop 83 may be secured by tightening a trigger stop locking screw 85 into the trigger block 58 until it contacts the front trigger stop 83. The trigger stop locking screw 85 may be positioned orthogonal to the front trigger stop 83 so that any force applied by contacting the trigger stop locking screw 85 against the front trigger stop 83 may provide a side load to the front trigger stop 83 and inhibit its movement.

A third adjustment may be provided by the third wrench 84 and adjusting the relative position of a safety spool pin 86 relative to the trigger block 58. The safety spool pin 86 may include a spring biased ball 88 on one end. The spring biased ball 88 may be received by one or more detent holes 90 in the safety spool 62. The third wrench 84 may be used to screw the safety spool pin 86 further into the trigger block 58. When this is done, the spring biased ball 88 applies a greater force to the safety spool 62, and when the spring biased ball 88 is received into a detent hole 90, a greater force must be applied to the safety lever 72 to rotate the safety spool 62 from a "safety on" to "safety off" position. This adjustment allows for the user to adjust the tension required to move and hold the safety lever 72 in each of the "safety on" and "safety off" positions.

Figure 12:
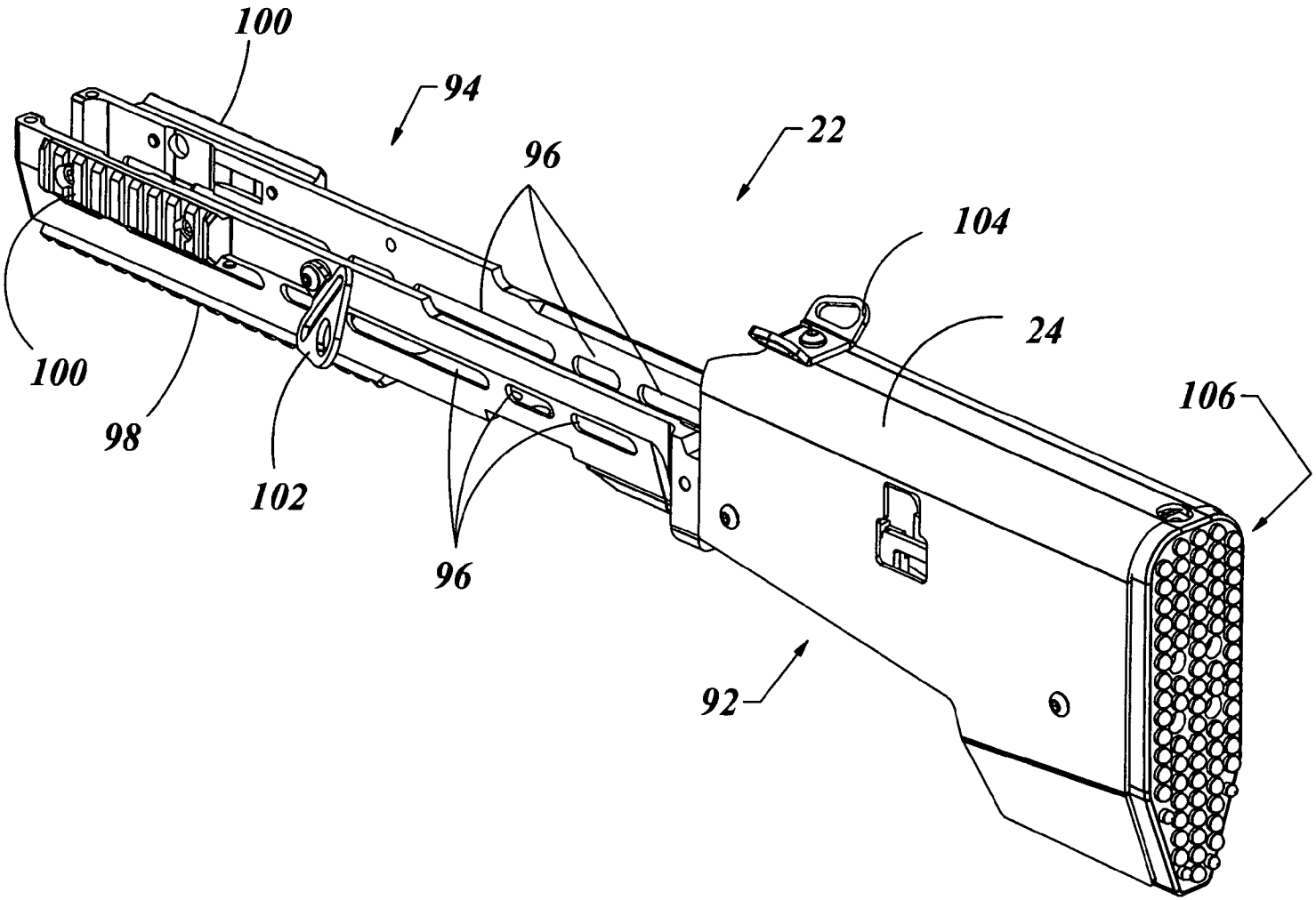
FIG. 12 is an isometric view of the stock and cheek panel of the rifle shown in FIG. 1.
Figure 13:
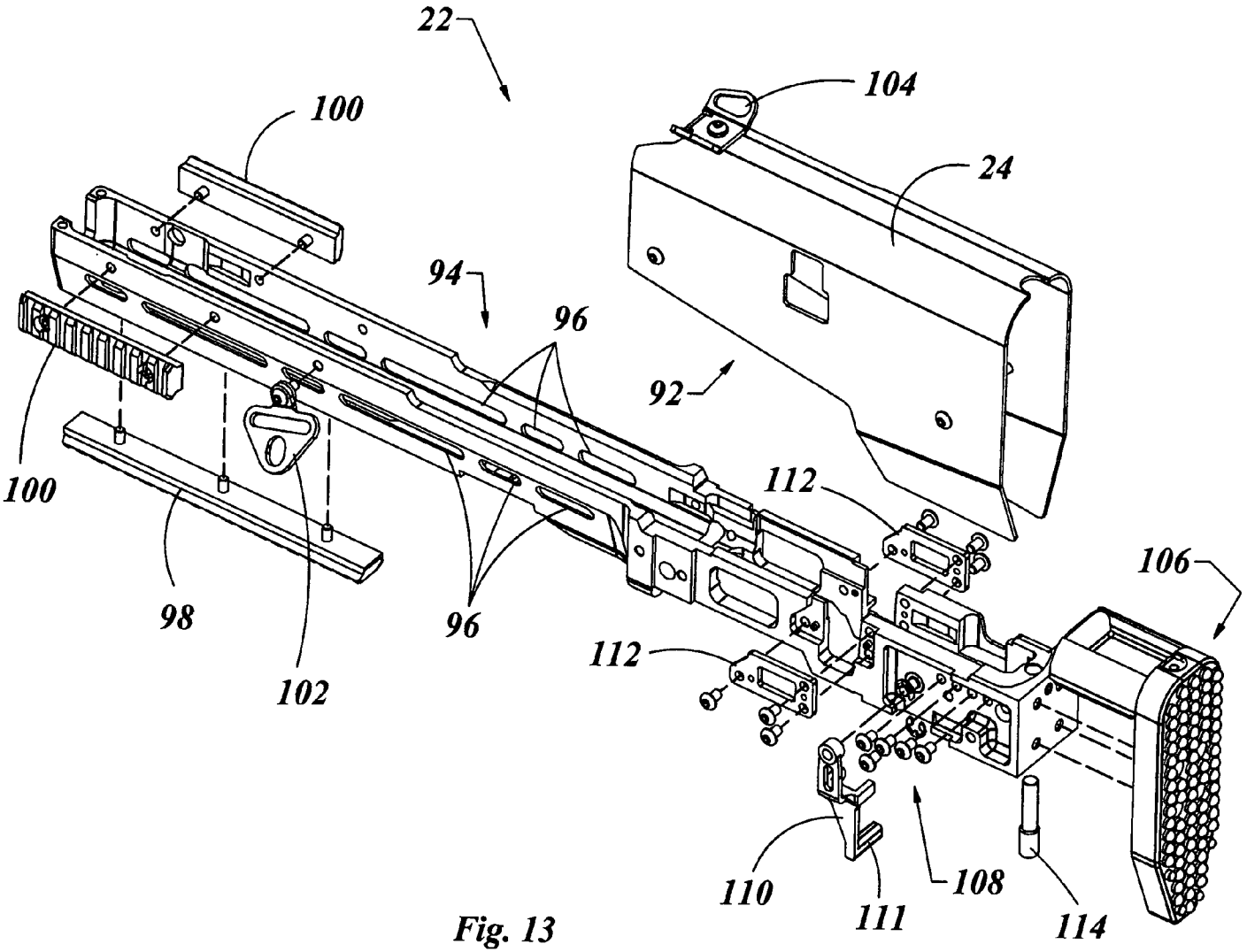
FIG. 13 is a partially disassembled isometric view of the stock and cheek panel as shown in FIG. 12.

The stock assembly 22 is shown in an assembled state in FIG. 12 and partially disassembled in FIG. 13. The general function of the stock assembly 22 is to support the upper rail assembly 18, and provide a comfortable interaction between the rifle assembly 16 and the user. One such comfort element is the cheek panel 24. The cheek panel 24 may provide a smooth and consistent surface so that the user may place the side of their face against the cheek panel 24 while the rifle assembly 16 is firing. Another function of the cheek panel 24 is to redirect the expired gas from the breach as the bolt moves to the rear at the moment a cartridge is fired and the spent brass is ejected. Without the cheek panel 24, high pressure gas may be directed back toward the operator. This may be more problematic when the rifle assembly 16 is used in either an automatic or semiautomatic firing mode. The cheek panel 24 may redirect the expired gas from the breach up and away from the operator. The cheek panel 24 may be enclosed on all sides with the exception of the open bottom section 92. In this embodiment of the invention the cheek panel 24 may include an open bottom section 92 for enabling access to the removable cartridge magazine 26 and also the primary safety 110.

The stock 94 may provide a cradle to support the barrel 28 of the rifle assembly 16. When firing, the barrel 28 may get extremely warm, especially when firing in full automatic. To help prevent burning the hand of the user, the stock 94 may support the barrel 28 while providing an air cushion between the outside of the barrel 28 and the interior portions of the stock 94. Slots 96 may also be provided in the stock 94 to assist airflow, and therefore the distribution of heat from the barrel 28. The stock 94 may also provide a means for supporting additional accessories. To facilitate this, a bottom rail 98 and side rails 100 may be mounted to the stock 94. Accessories that may be mounted to the bottom rail 98 or side rails 100 may include a bipod, laser sights or illumination (not shown here).

A rifle sling may also be used to help carry the rifle assembly 16 and to help support the rifle assembly 16 when firing. The sling (not shown here) may be supported by attachment to a front sling support 102, and a rear sling support 104. A recoil pad 106 may be provided on the distal end of the stock 94. The recoil pad 106 may be positioned against the shoulder of the user while firing the rifle assembly 16, thus aiding in dampening the impact force against the user due to the recoil of the rifle assembly 16 when firing. Spare cheek panel screws 108 may be stored on the stock 94 near the recoil pad 106.

A primary trigger safety 110 may be pivotally coupled to the stock 94. The primary trigger safety 110 may be incorporated within the firing control mechanism to provide a complete method to disable or enable the firing mechanism. The primary trigger safety 110 may be used to provide interference to movement of the primary trigger 38. The primary trigger safety 110 may be accessible to the user through the open bottom section 92 of the cheek panel 24 and operate as an additional safety. The original rifle safety may not be accessible to the user as the replacement stock may obstruct access to the original rifle safety. The primary trigger safety 110 may be coupled to the original rifle safety, and may include a safety arm 111. The safety arm 111 of the primary trigger safety 110 may extend the structure of the original rifle safety to account for the new stock. This may allow the original rifle safety to be actuated by way of the primary trigger safety 110. Therefore, if the weapon is dropped or sustains another type of stress, the likelihood of an accidental discharge of the weapon may be greatly reduced by locking the primary trigger 38 as well as the secondary trigger 32 as opposed to only the secondary trigger 32.

A pair of tie plates 112 may be used as a structural reinforcement to improve the mechanical strength of the stock 94. To provide for precise machining of the detail of the stock 94, a large amount of material may be required to be removed from the stock 94. The tie plates 112 may provide a precise and adjustable means of structural reinforcement of the stock 94 after the machining process. A receiver leveling screw 114 may be provided to the stock assembly 22, and may be positioned near the recoil pad 106. The receiver leveling screw 114 may be used to fine tune the vertical orientation of the barrel assembly group 40 when received into the stock assembly 22. In that the invention may provide a means to retrofit an existing barrel assembly group 40 into a new stock assembly 22, normal manufacturing variances of the barrel assembly group 40, possibly being produced according to slightly different specifications and produced in different factories, may provide variations in overall dimensions. To adjust for these variations, the receiver leveling screw 114 may fine tune the orientation of the barrel assembly group 40, and therefore the barrel 28 to the stock assembly 22. The result may be a more accurate and reliable rifle assembly 16. The leveling screw 114 may also be considered a part of the fire control mechanism. Due to variations in manufacturing tolerances and the desire to stabilize the rifle original trigger group assemblies, the leveling screw 114 may take a critical role in allowing the new parts to properly align with the old parts. That without some form of adjustment, such as the leveling screw 114, the assemblies may be either too loose or too tight, thereby affecting the operation of the firing control mechanism.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. A trigger assembly group of the type used with a rifle stock replacement system, the trigger assembly comprising:

a trigger assembly, including a trigger coupled to a first end of a trigger rod and a trigger roller coupled to a second end of the trigger rod, a locking plate coupled to the trigger rod and a preload cylinder coupled to the locking plate;

a trigger block including a recess receiving the trigger rod and the locking plate, whereby the recess in the trigger block acts as a guide to restrict movement of the trigger rod; and a safety spool rotatably coupled to the trigger block, the safety spool including a cross hole, the cross hole aligned with, and receiving the preload cylinder when the safety spool is in a first position and not able to receive the preload cylinder when the safety spool is in a second position, whereby when the safety spool is in the first position the trigger is able to move a distance relative to the trigger block and when the safety spool is in the second position, the trigger is able to move a lesser distance relative to the trigger block.

2. The trigger assembly group according to claim 1, wherein the preload cylinder is a threaded screw received in the locking plate.

3. The trigger assembly group according to claim 1, further comprising a preload locking screw received by the locking plate and positioned non-collinear with the preload cylinder.

4. The trigger assembly group according to claim 3, wherein the preload cylinder is substantially orthogonal to the preload locking screw, whereby the preload locking screw is adapted to provide a frictional force on the preload cylinder to restrict movement of the preload cylinder relative to the locking plate.

5. The trigger assembly group according to claim 1, further comprising a front trigger stop received by the trigger block and positioned to restrict the movement of the trigger assembly.

6. The trigger assembly group according to claim 5, further comprising a trigger stop locking screw received by the trigger block and positioned non-collinear with the front trigger stop.

7. The trigger assembly group according to claim 6, wherein the trigger stop locking screw is positioned substantially orthogonal to the front trigger stop, whereby the trigger stop locking screw is adapted to provide a frictional force on the front trigger stop to restrict movement of the front trigger stop relative to the trigger block.

8. The trigger assembly group according to claim 1, further comprising a safety spool pin received by the trigger block and adapted to provide a resistance to movement of the safety spool relative to the trigger block.

9. The trigger assembly group according to claim 8, wherein the safety spool pin includes a spring biased ball, the ball providing a frictional force on the safety spool.

10. The trigger assembly group according to claim 9, wherein the safety spool includes a detent hole adapted to receive a portion of the spring biased ball of the safety spool pin.

11. The trigger assembly group according to claim 1, further comprising a primary trigger safety, movably coupled to the a stock of the stock replacement system, the primary trigger safety coupled to an original safety of a rifle, the primary trigger safety including a safety arm accessible to a user and not obstructed by the stock.

12. A safety and trigger assembly group system for a firearm, comprising:

a trigger assembly, including:

a trigger coupled to a first end of a trigger rod;

a locking plate coupled to the trigger rod;

a preload cylinder coupled to the locking plate; and a trigger roller on a second end of the trigger rod;

a trigger block including a recess receiving the trigger rod, thereby providing guided movement of the trigger rod and the trigger assembly; and a safety spool rotatably coupled to the trigger block, the safety spool including a cross hole receiving the preload cylinder when the safety spool is in a first position and blocked from receiving the preload cylinder when the safety spool is rotated to a second position, whereby when the safety spool is in the first position the trigger is able to move a distance relative to the trigger block and when the safety spool is in the second position, the trigger is able to move a lesser distance relative to the trigger block.

13. The safety and trigger assembly group system according to claim 12, wherein the preload cylinder is a threaded screw received in the locking plate.

14. The safety and trigger assembly group system according to claim 12, further comprising a preload locking screw received by the locking plate and positioned non-collinear with the preload cylinder.

15. The safety and trigger assembly group system according to claim 14, wherein the preload cylinder is substantially orthogonal to the preload locking screw, whereby the preload locking screw is adapted to provide a frictional force on the preload cylinder to restrict movement of the preload cylinder relative to the locking plate.

16. The safety and trigger assembly group system according to claim 12, further comprising a front trigger stop received by the trigger block and positioned to restrict the movement of the trigger assembly.

17. The safety and trigger assembly group system according to claim 16, further comprising a trigger stop locking screw received by the trigger block and positioned non-collinear with the front trigger stop.

18. The safety and trigger assembly group system according to claim 17, wherein the trigger stop locking screw is positioned substantially orthogonal to the front trigger stop, whereby the trigger stop locking screw is adapted to provide a frictional force on the front trigger stop to restrict movement of the front trigger stop relative to the trigger block.

19. The safety and trigger assembly group system according to claim 12, further comprising a safety spool pin received by the trigger block and adapted to provide a resistance to movement of the safety spool relative to the trigger block.

20. The safety and trigger assembly group system according to claim 19, wherein the safety spool pin includes a spring biased ball, the ball providing a frictional force on the safety spool commensurate to the contact surface topography of the safety spool.

21. The safety and trigger assembly group system according to claim 20, wherein the safety spool includes a detent hole adapted to receive a portion of the spring biased ball of the safety spool pin.

22. The safety and trigger assembly group system according to claim 12, included in a stock assembly, the stock assembly further comprising a leveling screw positioned to contact a barrel, whereby the leveling screw is adapted to adjust the orientation of the barrel relative to the stock assembly.

* * * * *